US005620380A

United States Patent [19]

Tennent et al.

[11] Patent Number: 5,620,380

[45] **Date of Patent: *Apr. 15, 1997**

[54] LIGHT WEIGHT GOLF CLUB SHAFT HAVING CONTROLLABLE "FEEL"

[75] Inventors: Richard L. Tennent, Alpine; Richard G. Tennent, El Cajon, both of Calif.

[73] Assignee: UniFiber Corporation, San Diego, Calif.

[ * ] Notice: The term of this patent shall not extend beyond the expiration date of Pat. No. 5,265,872.

[21] Appl. No.: 569,755

[22] Filed: Dec. 8, 1995

[51] Int. Cl.[6] ..... A63B 53/10

[52] U.S. Cl. ..... 473/319; 273/DIG. 7; 273/DIG. 23

[58] Field of Search ..... 473/316, 317, 473/318, 320, 321, 305, 306, 307, 308, 309, 310, 300, 319; 273/DIG. 7, DIG. 23

[56] References Cited

U.S. PATENT DOCUMENTS

| | | |
|---|---|---|
| 1,890,538 | 12/1932 | Hadden . |
| 3,809,403 | 5/1974 | Hunter . |
| 4,135,035 | 1/1979 | Branen . |
| 4,809,983 | 3/1989 | Langert . |
| 5,018,735 | 5/1991 | Meredith . |
| 5,251,896 | 10/1993 | Gerlach . |
| 5,265,872 | 11/1993 | Tennent . |

*Primary Examiner*—Sebastiano Passaniti
*Attorney, Agent, or Firm*—Brown, Martin, Haller & McClain

[57] ABSTRACT

A light weight golf club shaft is described having a "modified hourglass" shape which provides many predetermined combinations of flex, stiffness and torque (which together are perceived as shaft and club "feel") and which is largely immune to breakage in normal play. The shaft is an improvement over our previous shaft defined in U.S. Pat. No. 5,265,872, and reduces shaft weight to the level desired by a golfer by using a substantially uniform shaft wall thickness while maintaining the unique "hour glass" external profile of our previous shaft. The shaft is formed of a base with axial sections: a grip section, an upper flare section, a flex control section, a lower flare section, and a hosel section, the whole forming an exterior shaft profile. The shaft may be made from metal such as steel, titanium, aluminum or their alloys, or composites formed of reinforcing fibers and polymeric materials. The preferred fibers for reinforcement are the carbon, ceramic, metallic, glass, aramid and extended chain polyethylene fibers, most preferably the carbon fibers. Preferred among the polymers which may be used are thermosetting resins such as the phenolics, polyesters, melamines, epoxies, polyimides, polyurethanes and silicones. The shafts may be produced by a variety of methods, including casting, molding (as around one or more mandrels), expanding or drawing.

16 Claims, 1 Drawing Sheet

LIGHT WEIGHT GOLF CLUB SHAFT HAVING CONTROLLABLE "FEEL"

BACKGROUND OF THE INVENTION

1. Field of the Invention

The invention herein relates to golf clubs. More particularly it relates to golf club shafts which can be configured for different degrees of "feel."

2. Description of the Prior Art

Golfers, particularly those of above-average skill, develop preferences for specific characteristics in golf clubs as they gain experience. One characteristic most often considered by golfers when selecting golf clubs and club sets for purchase is the "feel" of each club. By "feel" is meant the relative degree of flexibility of the golf club shaft. Some golfers prefer that a club be "stiff," i.e., that the club shaft have little flexibility when the club is swung. Others prefer that the club shaft be quite flexible, while still others look for clubs with shafts of intermediate flexibility. Further, the distribution of stiffness is significant, with individual preferences for either a relatively flexible tip or a relatively stiff tip.

In the past the degree of flexibility available in a club was largely dependent upon the material from which the shaft was made. Even after fiber composite materials began to replace metal as the principal club shaft material, club manufacturers continued to use shafts which had substantially the same degree of flexibility over a manufacturer's entire club line, so that a golfer who wanted a particular degree of "feel" had to examine different manufacturers' lines until finding a line manufactured with the desired degree of "feel." Thus a golfer could not readily find the optimum club set for his or her style of play, since a club line with the desired degree of "feel" might not have other characteristics desired by the golfer, such as club head or grip properties.

We have previously described and claimed a unique fiber composite golf club shaft in which the degree of "feel" can be defined and varied to meet any golfer's requirements; see U.S. Pat. No. 5,265,872, issued on Nov. 30, 1993. That shaft also provides for enhanced strength in the region where the shaft is joined to the hosel, thus overcoming a shaft breakage problem that had plagued prior art clubs made from fiber composite materials. Shafts within the scope of that patent have been exceptionally well received in the field, being produced commercially under the trademark "FLARE" and incorporated into premium grade golf clubs such as those available commercially from the Lynx Golf Company under the trademark "BLACK CAT."

SUMMARY OF THE INVENTION

While our previously patented shaft has been considered a major breakthrough in shaft technology, we have since realized that an even more improved shaft could be obtained if the weight of the shaft could also be varied without sacrificing its controllable "feel" and strength properties. Club weight, like "feel," is a characteristic for which golfers have their own personal preferences. Club weight is a function of all of the components of the club, particularly the shaft and the club head. Therefore, if the weight of the shaft could be readily varied, then the weight characteristics of the club head could also be varied without changing the overall weight of the club. Club manufacturers could then tailor clubs even more to an individual golfer's specific preferences as to shaft "feel," club weight and distribution of weight between shaft and head.

To obtain these benefits, we have developed an improvement over our previous "flex control" shaft. The present improved shaft is a golf club shaft of lighter weight which retains the desirable predetermined combinations of flex, stiffness and torque (which together are perceived as shaft and club "feel") of our previous shaft, and which like the previous shaft is virtually immune to breakage in normal play. In the present invention, however, we have also provided for reducing shaft weight to the level desired by a golfer by using a substantially uniform shaft wall thickness while maintaining the unique "hour glass" external profile of our previous shaft. With the external profile being maintained as previously chosen by an individual player, a uniform wall thickness can be selected to provide the overall weight desired by the player. This permits the manufacturer to tailor the present shafts to the individual "feel" properties desired by individual golfers even more closely than before, since the present structure now permits incorporation of individual weight specifications in addition to the previous profile specifications of the player.

Therefore, In a specific embodiment, the invention is a light weight golf club shaft having a predetermined combination of flex, stiffness and torque and being highly resistant to breakage, comprising an elongated hollow rod having a substantially uniform wall thickness, a top end and a bottom end, and having in adjacent order from bottom to top a hosel section, a lower flare section, a flex control section, an upper flare section, and a grip section; the flex control section having a substantially uniform outer diameter; the lower flare section having varying outer diameter increasing from the outer diameter of the flex control section at their mutual junction to a larger outer diameter at the junction of the lower flare section with the hosel section; the hosel section having an outer diameter not greater than the larger outer diameter of the lower flare section; the grip section being adapted to receive a hand grip surrounding at least a portion of an outer surface of the grip section; the sections in combination forming an external profile of the shaft; and the relative lengths of the flex control section and the lower flare section, the location of the junction therebetween and the external profile being determined by the relative amounts of flex, torque and stiffness desired in the shaft, the shaft thereby having light weight without loss of desired flex, torque and stiffness properties.

The materials from which the shafts of the present invention are made will be any of the commonly used metals such as steel, aluminum, titanium or their alloys, or composites formed of reinforcing fibers and polymeric materials. The preferred fibers for reinforcement are the carbon, glass, aramid and extended chain polyethylene fibers, most preferably the carbon fibers. Preferred among the polymers which may be used are thermosetting resins such as the phenolics, polyesters, melamines, epoxies, polyimides, polyurethanes and silicones. The shafts may be produced by a variety of methods, including casting, molding (as around one or more mandrels), expanding or drawing.

DETAILED DESCRIPTION AND PREFERRED EMBODIMENTS

Figure 1:
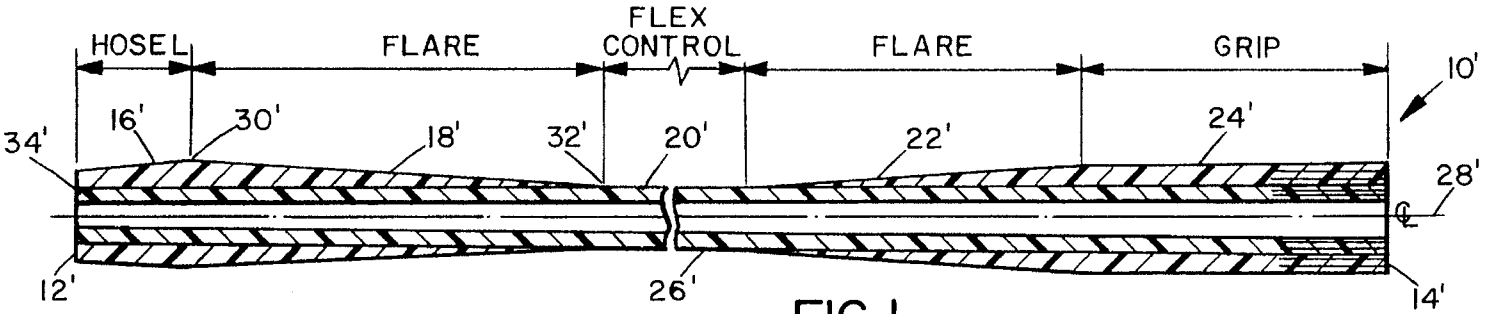
FIG. 1 PRIOR ART
FIG. 1 is an axial cross-sectional view of a golf club shaft of the type described and claimed in the aforesaid U.S. Pat. No. 5,265,872.

The shaft of the present invention is an improvement over the shaft disclosed and claimed in the aforementioned U.S. Pat. No. 5,265,872. The disclosures of that patent are incorporated herein by reference.

The present invention is best understood by reference to the Figures of the drawings. The overall configuration is illustrated for the present shaft in FIG. 2 and may be compared to the configuration of the prior art shaft of U.S. Pat. No. 5,265,872 illustrated in FIG. 1. (For convenience regular numerals will be used to indicate elements of the present shaft, and their counterparts in the prior art shaft will be indicated by the corresponding primed numerals. Where elements of the prior art shaft of FIG. 1 differ from elements of the present shaft of FIGS. 2 through 6, different unprimed numerals will be used.)

The basic external shaft configuration is what may be termed a "modified hour glass" shape. The shaft 10 is in five sections, which as designated from the bottom (hosel) end 12 to the top (grip) end 14 of the shaft are respectively the hosel section 16, the lower flare section 18, the flex control section 20, the upper flare section 22 and the grip section 24. While these sections represent slightly different structures physically, it will be understood they are all part of the unitary shaft structure and that there is physical separation between adjacent the sections. The sections are designated herein for ease in referring to the different regions of the structure of the shaft 10, rather than to imply that the shaft 10 itself is formed of separate individual components which must be physically connected.

In the prior shaft, there is a generally cylindrical substrate or base layer 26' which extends for the length of the shaft 10', and which is formed about axial centerline 28'. It is hollow throughout its length and has a slight inward taper toward the hosel end 12' of the shaft. The base layer 26' also forms the flex control section, such that the wall thickness of the flex control section is the wall thickness of the base layer 26'. The remaining sections of the shaft have thicker walls, and are formed by building up overlays or otherwise adding additional material on top of the outer surface of the base layer. The added materials or overlays are tapered, so that there is a smooth transition of the profile of one section to the profile of the next adjacent section. The greatest wall thickness generally occurs at the junction 30' of the lower flare section 18' and the hosel section 16' of the shaft 10'.

Figure 2:
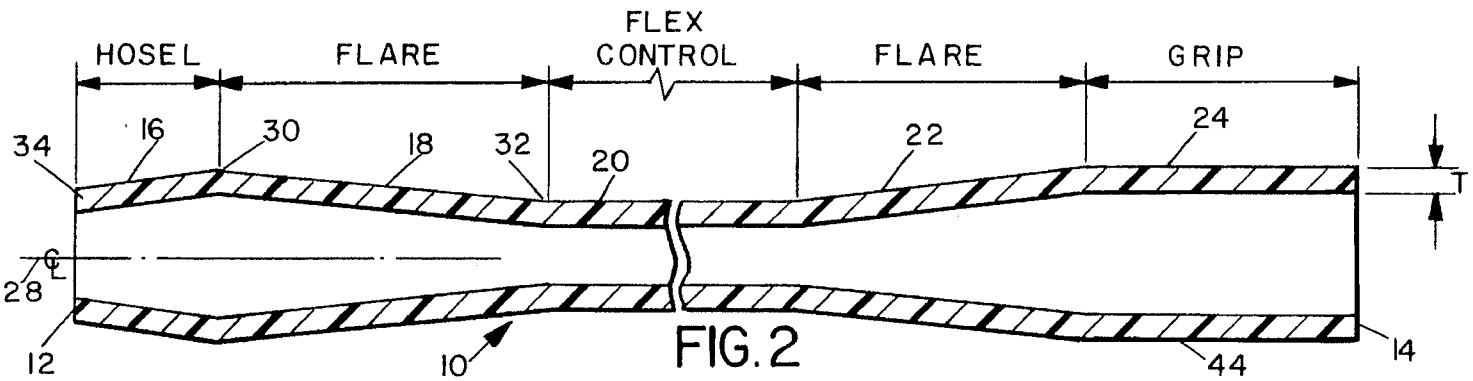
FIG. 2 is an axial cross sectional view, similar to that of FIG. 1, of a light weight golf club shaft of the present invention.

The difference between the two structures will be evident from comparison of FIGS. 1 and 2. While the exterior profile of the shaft is the same in both structures, the shaft 10 of the present invention not only is hollow but also has a uniform thickness T of exterior wall 34 throughout its length, such that the interior profile of the present shaft 10 conforms to its exterior profile, rather than having the straight (usually straight tapered) interior profile of the shaft 10' of the previous invention. The present shaft 10 thus is seen to have substantially less material forming it, and therefore necessarily has significantly less weight than a shaft 10' of the previous invention having the same exterior profile and length. The specific amount of weight reduction will be a function of the wall thickness of the present shaft. Commonly a weight reduction of about 1 to 2 oz (28.4 to 56.7 gm) will be desirable. Weight reductions of less can of course be made, but they will not provide significantly perceptible difference to the ordinary golfer as compared to the prior shaft 10'. Substantially greater weight reductions may unduly weaken the shaft, especially at the hosel end.

The average outside diameter of the shaft 10 in the flex control section 20 will be on the order of about 0.375" (1 cm) with a wall thickness of about 0.1" (2.5 mm). Thicknesses of wall 34 may vary from 0.030" to 0.080" (0.75 to 2.0 mm). Outer dimensions of other sections of the shaft 10 will be described below. It will be recognized that the exterior profile is to be maintained, since it is the relationship of the adjacent sections, and particularly the relative lengths of the upper and lower flare sections and the flex control section which provide the specific "feel" to each shaft.

Above the flex control section 20 and spaced from it by the upper flare section 22 is the grip section 24, which continues to the top end 14 of the shaft 10 with an outer surface having either a constant diameter or a slight outward taper. This permits a standard club grip to be fitted over the grip section 24 and adhered thereto in a conventional manner. The maximum diameter of grip section 24 is limited by the maximum outer diameter of the grip. The grip must have a diameter large enough, but not too large, to enable a player to comfortably hold and swing the club in the normal manner. Commonly the maximum outer diameter of the grip section 24 will be on the order of about 0.1" to 0.2" (2.5–5.0 mm) greater than the average outer diameter of the flex control section 20. Most players' hands are of similar sizes, and the standard outer sizes of golf club grips are well known and need not be detailed here.

As with the heavier prior art shaft, a critical element of the shaft structure is the flex control section 20. This may be referred to simply as the "flex point," although it will be recognized that it is an area of length of the shaft 10 and not a single axial point. As will be detailed below, this section 20 can be moved up or down the shaft 10 as the relative lengths of the flex control section 20 and the lower flare section 18, are varied, i.e., as the junction 32 between them is moved.

Also critical to the design of the shaft 10 is the outward taper of the lower flare section 18. This is a unique feature of both this improved shaft 10 and the prior shaft 10', since shafts prior to shaft 10' were designed to maintain either a constant diameter or, more commonly, a constant taper from the grip end 14 down to the lower end 12 within the club head hosel 36. In the present structure, however, the lower flare section 18 has an external profile which flares outwardly as indicated in FIGS. 2–5, to the junction point 30 of the lower flare section 18 and the hosel section 16. The diameter of the shaft at point 30 is commonly on the order of 0.5" (12 mm) and the external taper of the flare section 18 may be a straight taper or a curving taper.

Figure 4:
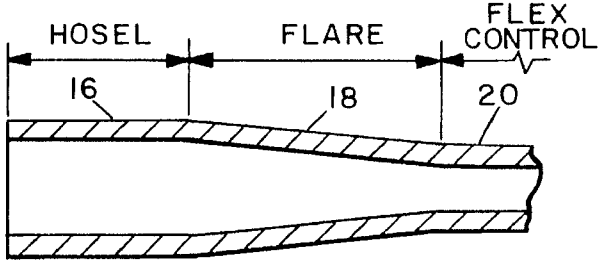
FIG. 4 is an axial cross-sectional view of another embodiment of the hosel end of a shaft of this invention.
Figure 3:
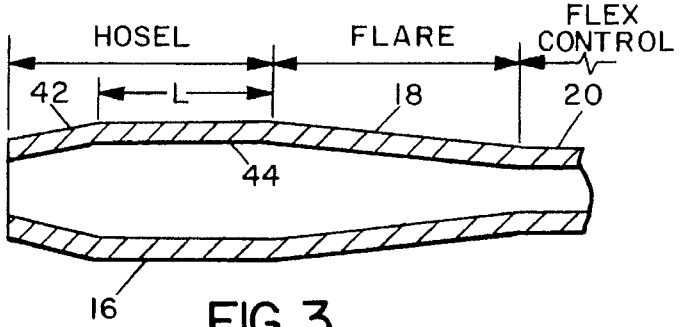
FIG. 3 is an axial cross-sectional view of one embodiment of the hosel end of a shaft of this invention.
Figure 5:
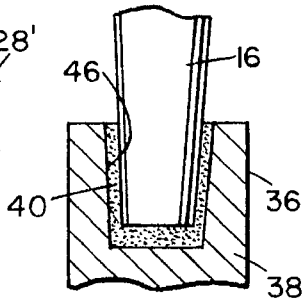
FIGS. 5 and 6 are axial cross-sectional view of the junction between the bottom (hosel) end of embodiments of shafts of this invention and the hosel of a golf club head, FIG. 5 illustrating an embodiment where the shaft end fits into a recess in the head hosel and FIG. 6 illustrating an embodiment where the hosel has a projection which fits into a recess in the shaft end.
Figure 6:
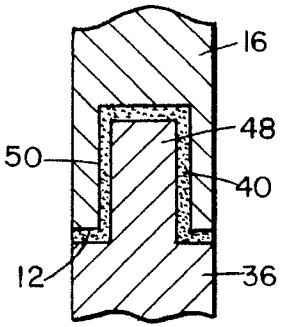

The hosel section 16 is the portion which is bonded to the hosel 36 of club head 38 as by adhesive 40. Hosel section 16 may have an inward taper as illustrated in FIG. 2, a parallel configuration as illustrated in FIG. 4, or a combination of the two, as illustrated in FIG. 3, in which portion 42 tapers inwardly and portion 44 is parallel (cylindrical) over its length L. The tapered configuration will be preferred when the shaft is to be fitted into the recess 46 in the top of the hosel 36; preferably the recess 46 has a corresponding profile, as illustrated in FIG. 5. Commonly the outer diameter of the lower end of a tapered hosel section 16 is on the order of approximately 0.4" (1 cm), with the taper being in the range of about 0.7%–1.2%. The parallel configuration, which has the same outer diameter as the diameter of the lower flare section 18 at point 30, will be preferred when the shaft 10 is to be fitted over projection 48 on the top of the hosel 36, where the projection 48 it seated in recess 50 in the hosel end 12 of the shaft 10. The projection 48 may be circular, square, hexagonal, or other polygonal shape in cross section, and may be parallel or tapered. Usually the recess 50 will have a generally corresponding shape, although since the space between the two will be filled with adhesive 40 conformance of shape is desirable but not required.

The widths of either embodiment of the hosel section 16 and the lower flare section 18, and their relationship to the club head hosel 36, provide several unique and important characteristics to the present shaft 10 which were not available until the development of the shaft 10' and which are carried forward into the present improved lighter weight shaft 10. The maximum diameter point 30 can be located at or slightly below the top of the recess 46 or slightly above the projection 48. Having the shaft 10 substantially flared outwardly to point 30 makes the shaft 10 virtually free of any tendency to break. In normal use, conventional golf club shafts almost always break at the same location: at the junction of the shaft with the top of the hosel. (Breakage at other points along the shaft length is normally a result of misuse of the club.) This had been a serious problem with club shafts prior to development of the shaft 10'. Since the earlier shafts had a constant diameter or taper throughout their length, the only way that the prior art knew to combat this problem was to thicken the wall of the entire shaft, which resulted in deterioration of club feel. Since players consider feel to be most important, they were forced to accept frequent club shaft breakage as a unwelcome detriment of clubs with the desired feel. With the improved lighter weight shaft 10 of this invention, desirable feel can be obtained with virtually no shaft breakage in normal play.

The dimensioning of the length of the shaft 10 is of major importance in the performance of the shaft. At the lower end 12, the length of the hosel section 16 is on the order of approximately 1.0" to 1.3" (2.5–3.3 cm) and, in the tapered embodiment, extends about 1.0" to 1.3" (25 to 33 mm) into the recess 46 of the hosel 36, or, in the parallel embodiment, the projection 48 is about 1.5" to 2.0" (38 to 51 mm) in length and the recess 50 has a corresponding depth which permits the end 12 of the shaft to be seated adjacent to the top of the hosel 36 with a portion of the adhesive 40 joining them. This length of the hosel section 24 is more a function of the club head than the shaft, and will be dependent upon the particular club head to be mounted on the shaft.

The length of the grip section 24 and the length of the upper flare portion 22 are also somewhat of a matter of choice, depending on the length of the shaft 10 that is to be designed and the length of the grip to be mounted. Typically the overall length of the grip section 24 will be 12" or more (30 cm or more) while the length of the upper flare section 22 will be on the order of about 12"–18" (30–45 cm).

The lengths of the flex control section 20 and the lower flare section 18 and their ratio are critical to the unique properties of the shaft of this invention. The lower flare section 18 is commonly approximately 12"–18" (30–45 cm) in length, and the flex control section 20 is about 6"–12" (15–30 cm) in length. However, the location of junction 32 where they meet can be varied according to the relative degrees of stiffness, torque and flex which are desired. If the location of junction 32 is moved upwardly on the shaft by extending the length of flare section 18 and (usually) also decreasing the length of flex control section 20, the stiffness of the shaft will increase. Conversely, if the location of junction 32 is moved downwardly on the shaft by reducing the length of lower flare section 18 and increasing the length of flex control section 20, the stiffness of the shaft will decrease. These relationships as stated are, of course, for a shaft of a given constant wall thickness. Shafts with greater wall thicknesses will be stiffer and less flexible than shafts having the same exterior profile (i.e., the same length and location of point 30) but thinner walls.

Thus by simple combinations of the length of the lower flare section 18 with respect to the length of the flex control section 20 and/or the wall thickness 34 of the shaft, one can produce a wide range of flex/torque/stiffness characteristics and readily provide club shafts to precisely meet the specific club characteristics which each individual player seeks.

From a commercial perspective, a vendor can produce shafts of a variety of predetermined ratios of the two sections and their thicknesses/diameters, as well as a variety of wall thicknesses, and thus provide a wide variety of graded degrees of flex/torque/stiffness ratios so that pro shops, golf supply stores, sporting goods stores and the like can readily stock light weight clubs of a variety of precise and predetermined club feels for selection by purchasers.

The materials from which the shafts of the present invention are made will be metal or any composite material formed of polymeric resins containing reinforcing fibers. The preferred metals are steel, aluminum, titanium and their alloys. The properties of such metals and metal alloys are widely published. The preferred fibers for reinforcement are carbon, ceramic, metallic, glass, aramid and extended chain polyethylene fibers, most preferably the carbon fibers. (As used herein, the term "carbon fibers" encompasses all carbon-based fibers, including "graphite fibers.") Reinforcement fibers are available commercially from a variety of sources and under numerous different trade names, including "Kevlar"™ for aramid fibers and "Spectra"™ for extended chain polyethylene fibers. These fibers, and their use as resin reinforcements, are widely described in the literature; one comprehensive source is Rubin (ed.), Handbook of Plastic Materials and Technology, chapters 70–77 (Wiley Interscience: 1990). Other sources include, for carbon fibers, Matlick, Fiber-Reinforced Composites: *Materials, Manufacturing, and Design* (Marcel Decker, New York: 1988); Gill, *Carbon Fibres in Composite Materials* (Iliffe Books, London: 1972) and Watt et al., Strong Fibers (Elsevier Science Publ., New York: 1985), and for other fibers, including glass and aramid, *Modem Plastics Encyclopedia* 88, 64, 10A, 183–190 (1987). Typical of the resins which may be used are thermosetting resins or polymers such as the phenolics, polyesters, melamines, epoxies, polyimides, polyurethanes and silicones; the properties and methods of manufacture of these polymers are also described in the previously mentioned *Handbook of Plastic Materials and Technology and Modern Plastics Encyclopedia* 88. It is also contemplated that some thermoplastic resins may also be useful, if the have the ability to withstand exposure to sun and ambient heat without distortion, particularly when flexing. While commercial thermoplastics do not currently meet such requirements, potentially acceptable thermoplastics have been reported as being under research, and such materials (and other similar materials which may be developed) should be considered to be useful in the present invention.

The shafts may be manufactured using currently available technology for forming metals and reinforced composites, such as casting, molding, expanding and drawing. Molding of composites using spray lay-up from the interior of a mold shaped to the outer profile is a suitable way of manufacturing shafts of the present invention, as is centrifugal casting for both metals and composites. It will be understood by those skilled in the art that such manufacturing processes, particularly when used with composites, will produce uniform outer surface for the shaft but the inner surface will be of a rough texture. This does not affect the requirement herein that the wall thicknesses be substantially constant, since the irregularities resulting from casting and molding are slight.

The light weight shafts of the present invention have highly desirable properties because of the unique modified hourglass shape. Not only do they have a very striking visual impact, but the structure allows for dampening of the various vibrational harmonics that are created during a golf swing, allowing one to optimize the feel characteristics of the club with respect to the player's individual swing characteristics. The shafts has good bending strength, high durability and, as noted, are so resistant to breakage, especially at the top of the club hosel, as to virtually eliminate the possibility of breakage during normal golf play.

It will be evident from the above that there are numerous embodiments of the present invention which while not expressly set forth above, are clearly within the scope and spirit of the invention. The above description is therefore intended to be exemplary only, and the full scope of the invention is to be defined solely by the appended claims.

We claim:

1. A light weight golf club shaft having a predetermined combination of flex, stiffness and torque and being highly resistant to breakage, comprising:

an elongated hollow rod having, a top end and a bottom end, and having in adjacent order from bottom to top a hosel section, a lower flare section, a flex control section, an upper flare section, and a grip section;

said flex control section having a substantially uniform outer diameter;

said lower flare section having varying outer diameter increasing from the outer diameter of said flex control section at their mutual junction to a larger outer diameter at the junction of said lower flare section with said hosel section;

said hosel section having an outer diameter not greater than said larger outer diameter of said lower flare section;

said grip section being adapted to receive a hand grip surrounding at least a portion of an outer surface of said grip section;

said sections in combination forming an external profile of said shaft;

all of said sections having the same uniform wall thickness, such that the interior profile of said hollow rod forming said shaft substantially conforms to said exterior profile of said shaft; and the relative lengths of said flex control section and said lower flare section, the location of said junction therebetween and said external profile being determined by the relative amounts of flex, torque and stiffness desired in said shaft, said shaft thereby having light weight without loss of desired flex, torque and stiffness properties.

2. A light weight golf club shaft as in claim 1 wherein said hosel section has varying outer diameter, with its outer diameter at said bottom end of said shaft being smaller than its outer diameter at its junction with said lower flare section.

3. A light weight golf club shaft as in claim 1 wherein said hosel section has constant outer diameter.

4. A light weight golf club shaft as in claim 1 wherein said hosel section has a cross sectional profile comprising a portion of varying outer diameter and a portion of constant outer diameter, with its outer diameter at said bottom end of said shaft being smaller than its outer diameter at its junction with said lower flare section.

5. A light weight golf club shaft as in claim 1 wherein said hosel section is adapted to be connected to a hosel of a golf club head by insertion of the bottom portion of said hosel section into a recess in said hosel of said club head.

6. A light weight golf club shaft as in claim 1 wherein said hosel section is adapted to be connected to a hosel of a golf club head by the bottom portion of said hosel section fitting over at least a portion of said hosel of said club head or a projection protruding therefrom.

7. A light weight golf club shaft as in claim 1 wherein said upper flare section has varying outer diameter increasing from the outer diameter of said flex control section at their mutual junction to a larger outer diameter at the junction of said upper flare section with said grip section; and said grip section has an outer diameter not greater than said larger outer diameter of said upper flare section.

8. A light weight golf club shaft as in claim 1 wherein said shaft comprises a metal or a composite of a polymeric material reinforced internally by elongated fibers.

9. A light weight golf club shaft as in claim 8 wherein said elongated fibers comprise a set of elongated parallel aligned fibers.

10. A light weight golf club shaft as in claim 8 wherein said fiber reinforcement is selected from the group consisting of carbon, ceramic, metallic, glass, aramid and extended chain polyethylene fibers.

11. A light weight golf club shaft as in claim 10 wherein said fiber reinforcement is carbon fibers.

12. A light weight golf club shaft as in claim 8 wherein said polymeric material comprises a thermoset polymer.

13. A light weight golf club shaft as in claim 8 wherein said metal comprises steel, titanium, aluminum or an alloy thereof.

14. A light weight golf club shaft as in claim 1 formed by casting, molding, expansion or drawing.

15. A light weight golf club shaft as in claim 14 formed by layup from the interior of a mold or by centrifugal casting.

16. A light weight golf club shaft as in claim 1 wherein the wall thickness of said shaft is in the range of 0.030–0.080 inch.

* * * * *